US009984696B2

(12) United States Patent
Faure et al.

(10) Patent No.: US 9,984,696 B2
(45) Date of Patent: May 29, 2018

(54) TRANSITION FROM A TRANSFORM CODING/DECODING TO A PREDICTIVE CODING/DECODING

(71) Applicant: Orange, Paris (FR)

(72) Inventors: Julien Faure, Ploubezre (FR); Stephane Ragot, Lannion (FR)

(73) Assignee: ORANGE, Paris (FR)

( * ) Notice: Subject to any disclaimer, the term of this patent is extended or adjusted under 35 U.S.C. 154(b) by 45 days.

(21) Appl. No.: 15/036,984

(22) PCT Filed: Nov. 14, 2014

(86) PCT No.: PCT/FR2014/052923
§ 371 (c)(1),
(2) Date: May 16, 2016

(87) PCT Pub. No.: WO2015/071613
PCT Pub. Date: May 21, 2015

(65) Prior Publication Data

US 2016/0293173 A1 Oct. 6, 2016

(30) Foreign Application Priority Data

Nov. 15, 2013 (FR) ..... 13 61243

(51) Int. Cl.
*G10L 19/20* (2013.01)
*G10L 19/02* (2013.01)
(Continued)

(52) U.S. Cl.
CPC ..... *G10L 19/0212* (2013.01); *G10L 19/022* (2013.01); *G10L 19/173* (2013.01);
(Continued)

(58) Field of Classification Search
CPC ..... G10L 19/18; G10L 19/20; G10L 19/22; G10L 19/24
See application file for complete search history.

(56) References Cited

U.S. PATENT DOCUMENTS 5,327,520 A * 7/1994 Chen ..... G10L 19/12 704/200
6,134,518 A * 10/2000 Cohen ..... G10L 19/18 704/201

(Continued)

FOREIGN PATENT DOCUMENTS

WO 2009059333 A1 5/2009
WO 2013016262 A1 1/2013

OTHER PUBLICATIONS

English translation of the Written Opinion of the International Searching Authority dated May 22, 2015, for corresponding International Application No. PCT/FR2014/052923, filed Nov. 14, 2014.

(Continued)

*Primary Examiner* — Eric Yen
(74) *Attorney, Agent, or Firm* — David D. Brush; Westman Champlin & Koehler, P.A.

(57) ABSTRACT

Methods and apparatus are provided for coding and decoding a digital audio signal. Decoding includes: decoding according to an inverse transform decoding of a previous frame of samples of the digital signal, which is received and coded according to a transform coding; and decoding according to a predictive decoding of a current frame of samples of the digital signal, which is received and coded according to a predictive coding. The predictive decoding of the current frame is a transition predictive decoding which does not use any adaptive dictionary arising from the previous frame. At least one state of the predictive decoding is reinitialized to a predetermined default value, and an add-overlap step combines a signal segment synthesized by (Continued)

predictive decoding of the current frame and a signal segment synthesized by inverse transform decoding, corresponding to a stored segment of the decoding of the previous frame.

16 Claims, 7 Drawing Sheets

(51) Int. Cl.
*G10L 19/022* (2013.01)
*G10L 19/16* (2013.01)
*G10L 19/04* (2013.01)
*G10L 19/26* (2013.01)

(52) U.S. Cl.
CPC ..... *G10L 19/20* (2013.01); *G10L 19/26* (2013.01); *G10L 19/04* (2013.01)

(56) References Cited

U.S. PATENT DOCUMENTS 6,169,970 B1 * 1/2001 Kleijn ..... G10L 19/12 704/219
6,311,154 B1 * 10/2001 Gersho ..... G10L 19/18 704/219
6,640,209 B1 * 10/2003 Das ..... G10L 19/18 704/207
6,959,274 B1 * 10/2005 Gao ..... G10L 19/20 704/207
7,103,538 B1 * 9/2006 Gao ..... G10L 19/08 704/219
7,693,710 B2 * 4/2010 Jelinek ..... G10L 19/005 704/207
2004/0148162 A1 * 7/2004 Fingscheidt ..... G10L 19/083 704/224
2006/0161427 A1 * 7/2006 Ojala ..... G10L 19/24 704/219
2006/0271359 A1 11/2006 Khalil et al.
2007/0233296 A1 * 10/2007 Kim ..... G10L 19/24 700/94
2009/0240491 A1 * 9/2009 Reznik ..... G10L 19/24 704/219
2009/0248406 A1 * 10/2009 Zhang ..... G10L 19/24 704/223
2010/0063804 A1 * 3/2010 Sato ..... G10L 19/038 704/207
2010/0076774 A1 * 3/2010 Breebaart ..... G10L 19/26 704/503
2010/0217607 A1 * 8/2010 Neuendorf ..... G10L 19/022 704/500
2010/0235173 A1 * 9/2010 Zhang ..... G10L 19/10 704/500
2011/0173008 A1 * 7/2011 Lecomte ..... G10L 19/20 704/500
2011/0320212 A1 * 12/2011 Tsujino ..... G10L 19/18 704/500
2012/0245947 A1 * 9/2012 Neuendorf ..... G10L 19/20 704/500

OTHER PUBLICATIONS

Lecomte et al., "Efficient Cross-Fade Windows for Transitions Between LPC-Based and Non-LPC Based Audio Coding", AES Convention 126; May 2009, AES 60 East 42nd Street, Room 2520 New York 10165-2520, USA, May 1, 2009 (May 1, 2009), XP040508994.
International Search Report dated Jan. 27, 2015, for corresponding international application No. PCT/FR2014/052923, filed Nov. 14, 2014.
Written Opinion dated May 22, 2015, for corresponding international application No. PCT/FR2014/052923, filed Nov. 14, 2014.

* cited by examiner

TRANSITION FROM A TRANSFORM CODING/DECODING TO A PREDICTIVE CODING/DECODING

CROSS-REFERENCE TO RELATED APPLICATIONS

This Application is a Section 371 National Stage Application of International Application No. PCT/FR2014/052923, filed Nov. 14, 2014, the content of which is incorporated herein by reference in its entirety, and published as WO 2015/071613 on May 21, 2015, not in English.

FIELD OF THE DISCLOSURE

The present invention relates to the field of the coding of digital signals.

The coding according to the invention is adapted in particular for the transmission and/or the storage of digital audio signals such as audiofrequency signals (speech, music or other).

The invention advantageously applies to the unified coding of speech, music and mixed content signals, by way of multi-mode techniques alternating at least two modes of coding and whose algorithmic delay is adapted for conversational applications (typically ≤40 ms).

BACKGROUND OF THE DISCLOSURE

To effectively code speech sounds, the techniques of CELP ("Code Excited Linear Prediction") type or its variant ACELP ("Algebraic Code Excited Linear Prediction") are advocated, alternatives to CELP coding such as the BV16, BV32, iLBC or SILK coders have also been proposed more recently. On the other hand, transform coding techniques are advocated to effectively code musical sounds.

Linear prediction coders, and more particularly those of CELP type, are predictive coders. Their aim is to model the production of speech on the basis of at least some part of the following elements: a short-term linear prediction to model the vocal tract, a long-term prediction to model the vibration of the vocal cords in a voiced period, and an excitation derived from a vector quantization dictionary in general termed a fixed dictionary (white noise, algebraic excitation) to represent the "innovation" which it was not possible to model by prediction.

The transform coders most used (MPEG AAC or ITU-T G.722.1 Annex C coder for example) use critical-sampling transforms of MDCT ("Modified Discrete Transform") type so as to compact the signal in the transformed domain. "Critical-sampling transform" refers to a transform for which the number of coefficients in the transformed domain is equal to the number of temporal samples analyzed.

A solution for effectively coding a signal containing these two types of content consists in selecting over time (frame by frame) the best technique. This solution has in particular been advocated by the 3GPP ("3rd Generation Partnership Project") standardization body through a technique named AMR WB+ (or Enhanced AMR-WB) and more recently by the MPEG-H USAC ("Unified Speech Audio Coding") codec. The applications envisaged by AMR-WB+ and USAC are not conversational, but correspond to broadcasting and storage services, without heavy constraints on the algorithmic delay.

The USAC standard is published in the ISO/IEC document 23003-3:2012, Information technology—MPEG audio technologies—Part 3: Unified speech and audio coding.

By way of illustration, the initial version of the USAC codec, called RM0 (Reference Model 0), is described in the article by M. Neuendorf et al., A Novel Scheme for Low Bitrate Unified Speech and Audio Coding—MPEG RM0, 7-10 May 2009, 126th AES Convention. This codec alternates between at least two modes of coding:

- For signals of speech type: LPD ("Linear Predictive Domain") modes using an ACELP technique
- For signals of music type: FD ("Frequency Domain") mode using an MDCT ("Modified Discrete Transform") technique.

The principles of the ACELP and MDCT codings are recalled hereinbelow.

On the one hand, CELP coding—including its ACELP variant—is a predictive coding based on the source-filter model. In general the filter corresponds to an all-pole filter with transfer function $1/A(z)$ obtained by linear prediction (LPC for Linear Predictive Coding). In practice the synthesis uses the quantized version, $1/\hat{A}(z)$, of the filter $1/A(z)$. The source—that is to say the excitation of the predictive linear filter $1/\hat{A}(z)$—is in general the combination of an excitation obtained by long-term prediction which models the vibration of the vocal cords, and of a stochastic excitation (or innovation) described in the form of algebraic codes (ACELP), of noise dictionaries, etc. The search for the "optimal" excitation is carried out by minimization of a quadratic error criterion in the domain of the signal weighted by a filter with transfer function $W(z)$ in general derived from the linear prediction filter $A(z)$, of the form $W(z)=A(z/\gamma 1)/A(z/\gamma 2)$. It will be noted that numerous variants of the CELP model have been proposed and the example of the CELP coding of the UIT-T G.718 standard will be retained here, in which two LPC filters are quantized per frame and the LPC excitation is coded as a function of a classification, with modes adapted for voiced, unvoiced, transient sounds, etc. Moreover, alternatives to CELP coding have also been proposed, including the BV16, BV32, iLBC or SILK coders which are still based on linear prediction. In general, predictive coding, including CELP coding, operates at limited sampling frequencies (≤16 kHz) for historical and other reasons (wide band linear prediction limits, algorithmic complexity for high frequencies, etc.); thus, to operate with frequencies of typically 16 to 48 kHz, resampling operations (by FIR filter, filter banks or IIR filter) are also used and optionally a separate coding for the high band which may be a parametric band extension—these resampling and high band coding operations are not reviewed here.

On the other hand, MDCT transformation coding is divided between three steps at the coder:

1. Weighting of the signal by a window called here "MDCT window" over a length corresponding to 2 blocks
2. Temporal aliasing (or "time-domain aliasing") to form a reduced block (of length divided by 2)
3. DCT-IV ("Discrete Cosine Transform") Transformation of the reduced block.

It will be noted that calculation variants of TDAC transformation type which can use for example a Fourier transform (FFT) instead of a DCT transform.

The MDCT window is in general divided into 4 adjacent portions of equal lengths called "quarters".

The signal is multiplied by the analysis window and then the aliasings are performed: the first quarter (windowed) is aliased (that is to say reversed in time and overlapped) on the second and the fourth quarter is aliased on the third.

More precisely, the aliasing of one quarter on another is performed in the following manner: The first sample of the first quarter is added to (or subtracted from) the last sample of the second quarter, the second sample of the first quarter is added to (or subtracted from) the last-but-one sample of the second quarter, and so on and so forth until the last sample of the first quarter which is added to (or subtracted from) the first sample of the second quarter.

Therefore, from 4 quarters are obtained 2 aliased quarters where each sample is the result of a linear combination of 2 samples of the signal to be coded. This linear combination is called temporal aliasing. It will be noted that temporal aliasing corresponds to mixing two temporal segments and the relative level of two temporal segments in each "aliased quarter" is dependent on the analysis/synthesis windows.

These 2 aliased quarters are thereafter coded jointly after DCT transformation. For the following frame there is a shift of half a window (i.e. 50% overlap), the third and fourth quarters of the previous frame become the first and second quarter of the current frame. After aliasing, a second linear combination of the same pairs of samples as in the previous frame is dispatched, but with different weights.

At the decoder, after inverse DCT transformation, the decoded version of these aliased signals is therefore obtained. Two consecutive frames contain the result of 2 different aliasings of the same 2 quarters, that is to say for each pair of samples we have the result of 2 linear combinations with different but known weights: an equation system is therefore solved to obtain the decoded version of the input signal, the temporal aliasing can thus be dispensed with by using 2 consecutive decoded frames.

The systems of equations mentioned are in general solved by de-aliasing, multiplication by a judiciously chosen synthesis window and then overlap-add of the common parts. This overlap-add ensures at the same time the gentle transition (without discontinuity due to quantization errors) between 2 consecutive decoded frames, indeed this operation behaves like a crossfade. When the window for the first quarter or fourth quarter is at zero for each sample, one speaks of an MDCT transformation without temporal aliasing in this part of the window. In this case the gentle transition is not ensured by the MDCT transformation, it must be done by other means such as for example an exterior crossfade.

Transform coding (including coding of MDCT type) can in theory easily be adapted to various input and output sampling frequencies, as illustrated by the combined implementation in annex C of G.722.1 including the G.722.1 coding; however, it is also possible to use transform coding with pre/post-processing operations with resampling (by FIR filter, filter banks or IIR filter), with optionally a separate coding of the high band which may be a parametric band extension—these resampling and high band coding operations are not reviewed here, but the 3GPP e-AAC+ coder gives an exemplary embodiment of such a combination (resampling, low band transform coding and band extension).

It should be noted that the acoustic band coded by the various modes (linear prediction based temporal LPD, transform based frequential FD) can vary according to the mode selected and the bitrate. Moreover, the mode decision may be carried out in open-loop for each frame, that is to say that the decision is taken a priori as a function of the data and of the observations available, or in closed-loop as in AMR-WB+ coding.

In codecs using at least two modes of coding, the transitions between LPD and FD modes are important in ensuring sufficient quality with no switching defect, knowing that the FD and LPD modes are of different kinds—one relies on a transform coding in the frequency domain of the signal, while the other uses a (temporal) predictive linear coding with filter memories which are updated at each frame. An example of managing the inter-mode switchings corresponding to the USAC RM0 codec is detailed in the article by J. Lecomte et al., "Efficient cross-fade windows for transitions between LPC-based and non-LPC based audio coding", 7-10 May 2009, 126th AES Convention. As explained in this article, the main difficulty resides in the transitions between LPD to FD modes and vice versa.

To deal with the problem of transition between a core of FD type to a core of LPD type, the patent application published under the number WO2013/016262 (illustrated in FIG. 1) proposes to update the memories of the filters of the codec of LPD type (130) coding the frame m+1 by using the synthesis of the coder and of the decoder of FD type (140) coding the frame m, the updating of the memories being necessary solely during the coding of the frames of FD type. This technique thus makes it possible during selection at 110 of the mode of coding and toggling (at 150) of the coding from FD to LPD type, to do so without transition defect (artifacts) since when coding the frame with the LPD technique, the memories (or states) of the CELP (LPD) coder have already been updated by the generator 160 on the basis of the reconstructed signal $\hat{S}_a(n)$ of the frame m. In the case where the two cores (FD and LDP) do not operate at the same sampling frequency, the technique described in patent application WO2013/016262 proposes a step of resampling the memories of the coder of FD type.

The drawback of this technique is on the one hand that it makes it necessary to have access to the decoded signal at the coder and therefore to force a local synthesis in the coder. On the other hand, it makes it necessary to carry out operations of updating the memories of the filters (possibly comprising a resampling step) during the coding and decoding of FD type, as well as a set of operations amounting to carrying out an analysis/coding of CELP type in the previous frame of FD type. These operations may be complex and are superimposed with the conventional operations of coding/decoding in the transition frame of LPD type, thereby causing a "multi-mode" coding complexity spike.

A need therefore exists to obtain an effective transition between a transform coding or decoding and a predictive coding or decoding which do not require an increase in complexity of the coders or decoders provided for conversational applications of audio coding exhibiting alternations of speech and of music.

SUMMARY

An exemplary aspect of the present application relates to a method for decoding a digital audio signal, comprising the steps of:

- decoding according to an inverse transform decoding of a previous frame of samples of the digital signal, received and coded according to a transform coding;
- decoding according to a predictive decoding of a current frame of samples of the digital signal, received and coded according to a predictive coding. The method is such that the predictive decoding of the current frame is a transition predictive decoding which does not use any adaptive dictionary arising from the previous frame and that it furthermore comprises:
- a step of reinitialization of at least one state of the predictive decoding to a predetermined default value;
- an overlap-add step which combines a signal segment synthesized by predictive decoding of the current frame and a signal segment synthesized by inverse transform decoding, corresponding to a stored segment of the decoding of the previous frame.

Thus, the reinitialization of the states is performed without there being any need for the decoded signal of the previous frame, it is performed in a very simple manner through predetermined or zero constant values. The complexity of the decoder is thus decreased with respect to the techniques for updating the state memories requiring analysis or other calculations. The transition artifacts are then avoided by the implementation of the overlap-add step which makes it possible to tie the link with the previous frame.

With the transition predictive decoding, it is not necessary to reinitialize the memories of the adaptive dictionary for this current frame, since it is not used. This further simplifies the implementation of the transition.

In a particular embodiment, the inverse transform decoding has a smaller processing delay than that of the predictive decoding and the first segment of current frame decoded by predictive decoding is replaced with a segment arising from the decoding of the previous frame corresponding to the delay shift and placement in memory during the decoding of the previous frame.

This makes it possible advantageously to use this delay shift to improve the quality of the transition.

In a particular embodiment, the signal segment synthesized by inverse transform decoding is corrected before the overlap-add step by the application of an inverse window compensating the windowing previously applied to the segment.

Thus, the decoded current frame has an energy which is close to that of the original signal.

In a variant embodiment, the signal segment synthesized by inverse transform decoding is resampled beforehand at the sampling frequency corresponding to the decoded signal segment of the current frame.

This makes it possible to perform a transition without defect in the case where the sampling frequency of the transform decoding is different from that of the predictive decoding.

In one embodiment of the invention, a state of the predictive decoding is in the list of the following states:

- the state memory for a filter for resampling at the internal frequency of the predictive decoding;
- the state memories for pre-emphasis/de-emphasis filters;
- the coefficients of the linear prediction filter;
- the state memory of the synthesis filter (in the preaccentuated domain);
- the memory of the adaptive dictionary (past excitation);
- the state memory of a low-frequency post-filter (LPF);
- the quantization memory for the fixed dictionary gain.

These states are used to implement the predictive decoding. Most of these states are reinitialized to a zero value or a predetermined constant value, thereby further simplifying the implementation of this step. This list is however not exhaustive and other states can very obviously be taken into account in this reinitialization step.

In a particular embodiment of the invention, the calculation of the coefficients of the linear prediction filter for the current frame is performed by the decoding of the coefficients of a unique filter and by allotting identical coefficients to the end-, middle- and start-of-frame linear prediction filter.

Indeed, as the coefficients of the linear prediction filter have been reinitialized, the start-of-frame coefficients are not known. The decoded values are then used to obtain the coefficients of the linear prediction filter for the complete frame. This is therefore performed in a simple manner yet without affording significant degradation to the decoded audio signal.

In a variant embodiment, the calculation of the coefficients of the linear prediction filter for the current frame comprises the following steps:

- determination of the decoded values of the coefficients of the middle-of-frame filter by using the decoded values of the coefficients of the end-of-frame filter and a predetermined reinitialization value of the coefficients of the start-of-frame filter;
- replacement of the decoded values of the coefficients of the start-of-frame filter by the decoded values of the coefficients of the middle-of-frame filter;
- determination of the coefficients of the linear prediction filter for the current frame by using the values thus decoded of the coefficients of the end-, middle- and start-of-frame filter.

Thus, the coefficients corresponding to the middle-of-frame filter are decoded with a lower error.

In another variant embodiment, the coefficients of the start-of-frame linear prediction filter are reinitialized to a predetermined value corresponding to an average value of the long-term prediction filter coefficients and the linear prediction coefficients for the current frame are determined by using the values thus predetermined and the decoded values of the coefficients of the end-of-frame filter.

Thus, the start-of-frame coefficients are considered to be known with the predetermined value. This makes it possible to retrieve the coefficients of the complete frame in a more exact manner and to stabilize the predictive decoding more rapidly.

In a possible embodiment, a predetermined default value depends on the type of frame to be decoded.

Thus the decoding is well-adapted to the signal to be decoded.

The invention also pertains to a method for coding a digital audio signal, comprising the steps of:

- coding of a previous frame of samples of the digital signal according to a transform coding;
- reception of a current frame of samples of the digital signal to be coded according to a predictive coding. The method is such that the predictive coding of the current frame is a transition predictive coding which does not use any adaptive dictionary arising from the previous frame and that it furthermore comprises:
  - a step of reinitialization of at least one state of the predictive coding to a predetermined default value.

Thus, the reinitialization of the states is performed without any need for reconstruction of the signal of the previous frame and therefore for local decoding. It is performed in a very simple manner through predetermined or zero constant values. The complexity of the coding is thus decreased with respect to the techniques for updating the state memories requiring analysis or other calculations.

With the transition predictive coding, it is not necessary to reinitialize the memories of the adaptive dictionary for this current frame, since it is not used. This further simplifies the implementation of the transition.

In a particular embodiment, the coefficients of the linear prediction filter form part of at least one state of the predictive coding and the calculation of the coefficients of the linear prediction filter for the current frame is performed by the determination of the coded values of the coefficients of a single prediction filter, either of middle or of end of frame and of allotting of identical coded values for the coefficients of the start-of-frame and end-or middle-of-frame prediction filter.

Indeed, as the coefficients of the linear prediction filter have been reinitialized, the start-of-frame coefficients are not known. The coded values are then used to obtain the coefficients of the linear prediction filter for the complete frame. This is therefore performed in a simple manner yet without affording significant degradation to the coded sound signal.

Thus, advantageously, at least one state of the predictive coding is coded in a direct manner.

Indeed, the bits normally reserved for the coding of the set of coefficients of the middle-of-frame or start-of-frame filter are for example used to code in a direct manner at least one state of the predictive coding, for example the memory of the de-emphasis filter.

In a variant embodiment, the coefficients of the linear prediction filter form part of at least one state of the predictive coding and the calculation of the coefficients of the linear prediction filter for the current frame comprises the following steps:

- determination of the coded values of the coefficients of the middle-of-frame filter by using the coded values of the coefficients of the end-of-frame filter and the predetermined reinitialization values of the coefficients of the start-of-frame filter;
- replacement of the coded values of the coefficients of the start-of-frame filter by the coded values of the coefficients of the middle-of-frame filter;
- determination of the coefficients of the linear prediction filter for the current frame by using the values thus coded of the coefficients of the end-, middle- and start-of-frame filter.

Thus, the coefficients corresponding to the middle-of-frame filter are coded with a smaller percentage error.

In a variant embodiment, the coefficients of the linear prediction filter form part of at least one state of the predictive coding, the coefficients of the start-of-frame linear prediction filter are reinitialized to a predetermined value corresponding to an average value of the long-term prediction filter coefficients and the linear prediction coefficients for the current frame are determined by using the values thus predetermined and the coded values of the coefficients of the end-of-frame filter.

Thus, the start-of-frame coefficients are considered to be known with the predetermined value. This makes it possible to obtain a good estimation of the prediction coefficients of the previous frame, without additional analysis, to calculate the prediction coefficients of the complete frame.

In a possible embodiment, a predetermined default value depends on the type of frame to be coded.

The invention also pertains to a digital audio signal decoder, comprising:

- an inverse transform decoding entity able to decode a previous frame of samples of the digital signal, received and coded according to a transform coding;
- a predictive decoding entity able to decode a current frame of samples of the digital signal, received and coded according to a predictive coding. The decoder is such that the predictive decoding of the current frame is a transition predictive decoding which does not use any adaptive dictionary arising from the previous frame and that it furthermore comprises:
- a reinitialization module able to reinitialize at least one state of the predictive decoding by a predetermined default value;
- a processing module able to perform an overlap-add which combines a signal segment synthesized by predictive decoding of the current frame and a signal segment synthesized by inverse transform decoding, corresponding to a stored segment of the decoding of the previous frame.

Likewise the invention pertains to a digital audio signal coder, comprising:

- a transform coding entity able to code a previous frame of samples of the digital signal;
- a predictive coding entity able to code a current frame of samples of the digital signal. The coder is such that the predictive coding of the current frame is a transition predictive coding which does not use any adaptive dictionary arising from the previous frame and that it furthermore comprises:
- a reinitialization module able to reinitialize at least one state of the predictive coding by a predetermined default value.

The decoder and the coder afford the same advantages as the decoding and coding methods that they respectively implement.

Finally, the invention pertains to a computer program comprising code instructions for the implementation of the steps of the decoding method such as previously described and/or of the coding method such as previously described, when these instructions are executed by a processor.

The invention also pertains to a storage means, readable by a processor, possibly integrated into the decoder or into the coder, optionally removable, storing a computer program implementing a decoding method and/or a coding method such as previously described.

BRIEF DESCRIPTION OF THE DRAWINGS

Other characteristics and advantages of the invention will become apparent on examining the description detailed hereinafter, and the appended figures among which.

DETAILED DESCRIPTION OF ILLUSTRATIVE EMBODIMENTS

Figure 1:
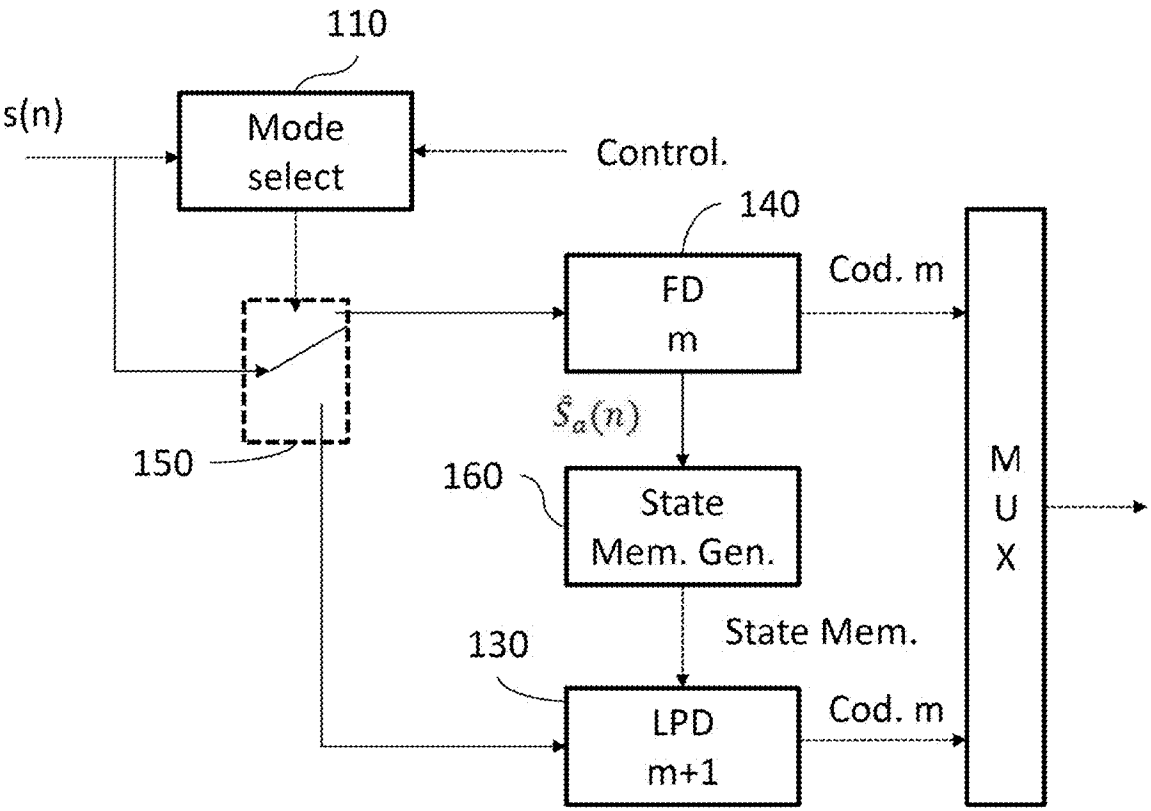
Fig.1 (Prior Art)
FIG. 1 illustrates a process of transition, between a transform coding and a predictive coding, of the state of the art and described previously.
Figure 2:
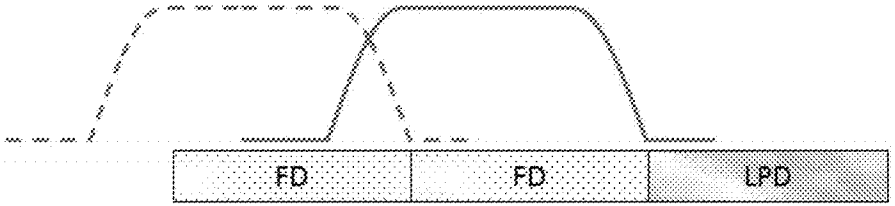
FIG. 2 illustrates the transition at the coder between a frame coded according to a transform coding and a frame coded according to a predictive coding, according to an implementation of the invention.

FIG. 2 illustrates in a schematic manner, the principle of coding during a transition between a transform coding and a predictive coding according to the invention. Considered here is a succession of audio frame to be coded either with a transform coder (FD) for example of MDCT type or with a predictive coder (LPD) for example of ACELP type; it will be noted that additional coding modes are possible without affecting the invention. In this example the transform coder (FD) uses windows with small delay of "Tukey" type (the invention is independent of the type of window used) and whose total length is equal to two frames (zero values inclusive) as represented in the figure.

During coding, the windows of the FD coder are synchronized in such a way that the last non-zero part of the window (on the right) corresponds with the end of a new frame of the input signal. Note that the splitting into frames illustrated in FIG. 2 includes the "lookahead" (or future signal) and the frame actually coded is therefore typically shifted in time (delayed) as explained further on in relation to FIG. 5. When there is no transition, the coder performs the aliasing and DCT transformation procedure such as described in the state of the art (MDCT). Upon the arrival of the frame having to be coded by a coder of LPD type, the window is not applied, the states or memories corresponding to the filters of the LPD coder are reinitialized to predetermined values.

It is considered here that the LPD coder is derived from the UIT-T G.718 coder whose CELP coding operates at an internal frequency of 12.8 kHz. The LPD coder according to the invention can operate at two internal frequencies 12.8 kHz or 16 kHz according to the bitrate.

By state of the predictive coding (LPD), at least the following states are implied:

- The state memory of the resampling filter for the input frequency fs at the internal frequency of the CELP coding (12.8 or 16 kHz). It is considered here that the resampling can be performed as a function of the input frequency and internal frequency by FIR filter, filter bank or IIR filter, knowing that an embodiment of FIR type simplifies the use of the state memory which corresponds to the past input signal.
- The state memories of the pre-emphasis filter ($1-\alpha z^{-1}$ with typically $\alpha=0.68$) and de-emphasis filter ($1/(1-\alpha z^{-1})$).
- The coefficients of the linear prediction filter at the end of the previous frame or their equivalent version in the domains such as the LSF ("Line Spectral Frequencies") or ISF ("Imittance Spectral Frequencies") domains.
- The state memory of the LPC synthesis filter typically of order 16 (in the preaccentuated domain).
- The memory of the adaptive dictionary (past CELP excitation).
- The state memory of the low-frequency post-filter (LPF) as defined in the standard UIT-G.718 (see clause 7.14.1.1 of the standard UIT-T G.718).
- The quantization memory for the fixed dictionary gain (when this quantization is performed with memory).

Figure 3:
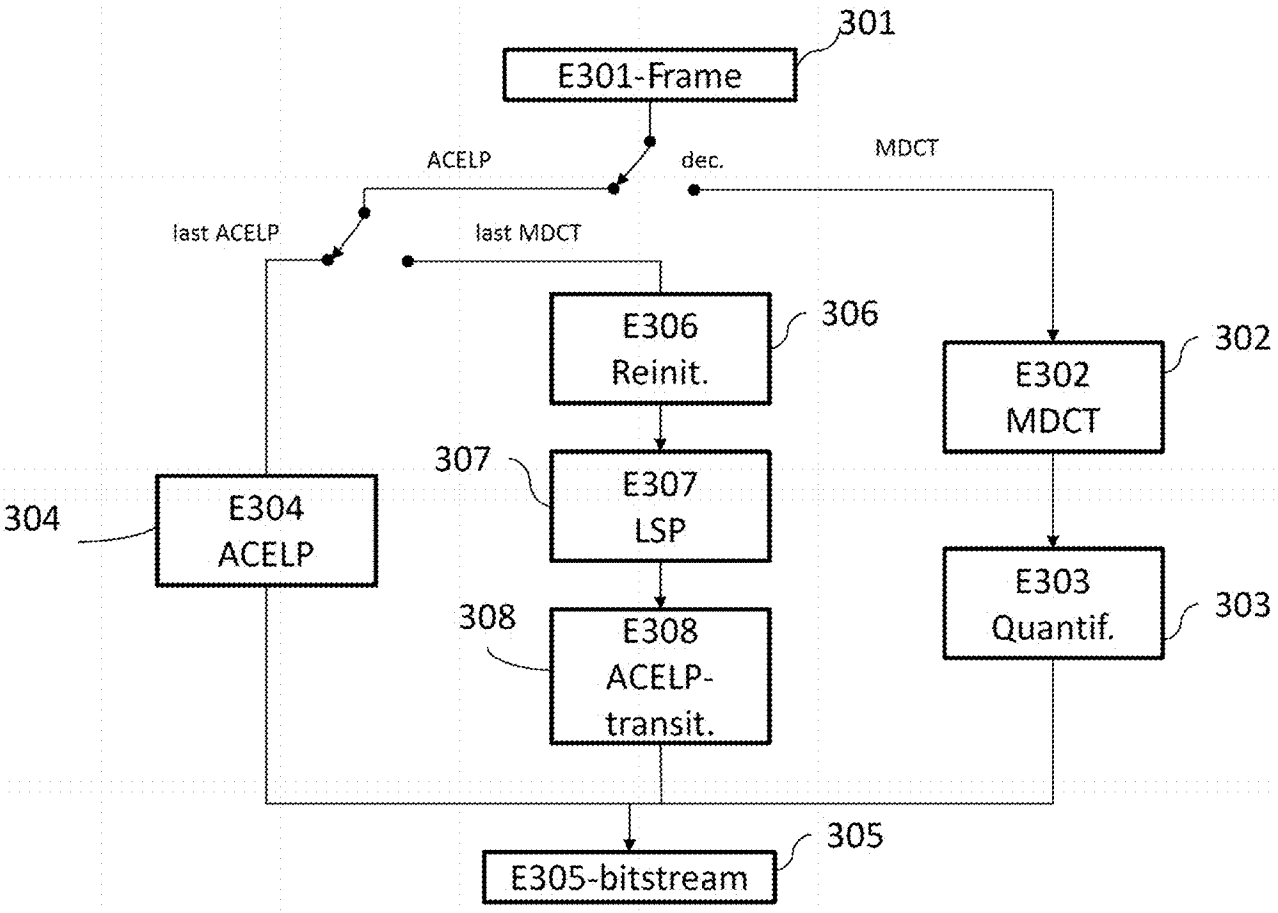
FIG. 3 illustrates an embodiment of the coding method and of the coder according to the invention.

FIG. 3 illustrates an embodiment of a coder and of a coding method according to the invention.

The particular embodiment lies within the framework of transition between an FD transform codec using an MDCT and a predictive codec of ACELP type.

After a first conventional step of placement in frame (E301) by a module 301, a decision module (dec.) determines whether the frame to be processed should be coded by ACELP predictive coding or by FD transform coding.

In the case of the transform coding, a complete step of MDCT transform is performed (E302) by the transform coding entity 302. This step comprises inter alia a windowing with a low-lag window aligned as illustrated in FIG. 2, a step of aliasing and a step of transformation in the DCT domain. The frame FD is thereafter quantized in a step (E303) by a quantization module 303 and then the data thus encoded are written in the bitstream at E305, by the bitstream construction module 305.

The case of the transition from a predictive coding to a transform coding is not dealt with in this example since it does not form the subject of the present invention.

If the decision step (dec.) chooses the ACELP predictive coding, then:

- Either the previous frame (last ACELP) had also been encoded by the ACELP coding entity 304, the ACELP coding (E304) then continues while updating the memories or states of the predictive coding. We do not deal here with the problem of switching of internal sampling frequencies of the CELP coding (from 12.8 to 16 kHz and vice-versa). The coded and quantized information is written in the bitstream in a step E305.
- Or the previous frame (last MDCT) had been encoded by the transform coding entity 302, at E302, in this case, the memories or states of the ACELP predictive coding are reinitialized in a step (E306) to default values (not necessarily zero) predetermined in advance. This reinitialization step is implemented by the reinitialization module 306, for at least one state of the predictive coding.

A step of predictive coding for the current frame is then implemented at E308 by a predictive coding entity 308.

The coded and quantized information is written in the bitstream in step E305.

This predictive coding E308 can, in a particular embodiment, be a transition coding such as defined by the name 'TC mode' in the standard UIT-T G.718, in which the coding of the excitation is direct and does not use any adaptive dictionary arising from the previous frame. A coding, which is independent of the previous frame, of the excitation is then carried out. This embodiment allows the predictive coders of LPD type to stabilize much more rapidly (with respect to a conventional CELP coding which would use an adaptive dictionary which would be set to zero). This further simplifies the implementation of the transition according to the invention.

In a variant of the invention, it will be possible for the coding of the excitation not to be in a transition mode but for it to use a CELP coding in a manner similar to G.718 and possibly using an adaptive dictionary (without forcing or limiting the classification) or a conventional CELP coding with adaptive and fixed dictionaries. This variant is however less advantageous since, the adaptive dictionary not having been recalculated and having been set to zero, the coding will be sub-optimal.

In another variant, the CELP coding in the transition frame by TC mode will be able to be replaced with any other type of coding which is independent of the previous frame, for example by using the coding model of iLBC type.

In a particular embodiment, a step E307 of calculating the coefficients of the linear prediction filter for the current frame is performed by the calculation module 307.

Several modes of calculation of the coefficients of the linear prediction filter are possible for the current frame. It is considered here that the predictive coding (block 304) performs two linear prediction analyses per frame as in the standard G.718, with a coding of the LPC coefficients in the form of ISF (or LSF in an equivalent manner) obtained at the end of frame (NEW) and a very reduced bitrate coding of the LPC coefficients obtained in the middle of the frame (MID), with an interpolation by sub-frame between the LPC coefficients of the end of previous frame (OLD), and those of the current frame (MID and NEW).

In a first embodiment, the prediction coefficients in the previous frame (OLD) of FD type are not known since no LPC coefficient is coded in the FD coder. One then chooses to code a single coefficient set of the linear prediction filter which corresponds either to the middle of the frame (MID) or else to the end of the frame (NEW). This choice may be for example made according to a classification of the signal to be coded. For a stable signal, it will be possible to choose the middle-of-frame filter. An arbitrary choice can also be made; in the case where the choice pertains to the LPC coefficients in the middle of the frame, in a variant, the interpolation of the LPC coefficients (in the ISP ("Imittance Spectral Pairs") domain or LSP ("Line Spectral Pairs") domain) will be able to be modified in the second LPD frame which follows the transition LPD frame.

On the basis of these coded values obtained, identical coded values are allotted for the prediction filter coefficients for frame start (OLD) and for frame end or middle according to the choice which has been made. Indeed, the LPC coefficients of the previous frame (OLD) not being known, it is not possible to code the frame middle (MID) LPC coefficients as in G.718. It will be noted that in this variant the reinitialization of the LPC coefficients (OLD) is not absolutely necessary, since these coefficients are not used. In this case, the coefficients used in each sub-frame are fixed in a manner identical to the value coded in the frame.

Advantageously, the bits which could be reserved for the coding of the set of frame middle (MID) or frame start LPC coefficients are used for example to code in a direct manner at least one state of the predictive coding, for example the memory of the de-emphasis filter.

Figure 4:
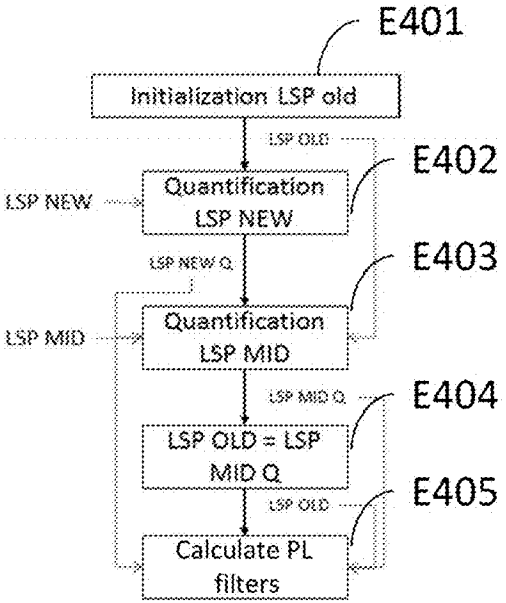
FIG. 4 illustrates in the form of a flowchart the steps implemented in a particular embodiment, to determine the coefficients of the linear prediction filter during the predictive coding of the current frame, the previous frame having been coded according to a transform coding.

In a second possible embodiment, the steps illustrated in FIG. 4 are implemented. A first step E401 is the initialization of the coefficients of the prediction filter and of the equivalent ISF or LSF representations according to the implementation of step E306 of FIG. 3, that is to say to predetermined values, for example according to the long-term average value over an a priori learning base for the LSP coefficients. Step E402 codes the coefficients of the end-of-frame filter (LSP NEW) and the coded values obtained (LEP NEW Q) as well as the predetermined reinitialization values of the coefficients of the start-of-frame filter (LSP OLD) are used in E403 to code the coefficients of the middle-of-frame prediction filter (LSP MID). A step of replacement E404 of the values of start-of-frame coefficients (LSP OLD) by the coded values of the middle-of-frame coefficients (LSP MID Q), is performed. Step E405 makes it possible to determine the coefficients of the linear prediction filter for the current frame on the basis of these values thus coded (LSP OLD, LSP MID Q, LSP NEW Q).

In a third possible embodiment, the coefficients of the linear prediction filter for the previous frame (LSP OLD) are initialized to a value which is already available "free of charge" in an FD coder variant using a spectral envelope of LPC type. In this case, it will be possible to use a "normal" coding such as used in G.718, the sub-frame-based linear prediction coefficients being calculated as an interpolation between the values of the prediction filters OLD, MID and NEW, this operation thus allows the LPD coder to obtain without additional analysis a good estimation of the LPC coefficients in the previous frame.

In other variants of the invention, the coding LPD will be able by default to code just a set of LPC coefficients (NEW), the previous variant embodiments are simply adapted to take into account that no set of coefficients is available in the frame middle (MID).

In a variant embodiment of the invention, the initialization of the states of the predictive coding can be performed with default values predetermined in advance which can for example correspond to various types of frame to be encoded (for example the initialization values can be different if the frame comprises a signal of voiced or unvoiced type).

Figure 5:
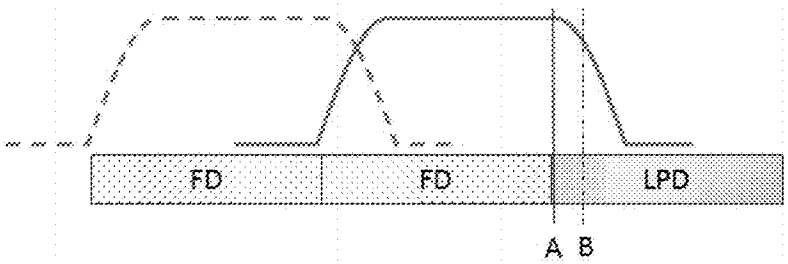
FIG. 5 illustrates the transition at the decoder between a frame decoded according to an inverse transform decoding and a frame decoded according to a predictive decoding, according to an implementation of the invention.

FIG. 5 illustrates in a schematic manner, the principle of decoding during a transition between a transform decoding and a predictive decoding according to the invention.

Considered here is a succession of audio frame to be decoded either with a transform decoder (FD) for example of MDCT type or with a predictive decoder (LPD) for example of ACELP type. In this example the transform decoder (FD) uses small-delay synthesis windows of "Tukey" type (the invention is independent of the type of window used) and whose total length is equal to two frames (zero values inclusive) as represented in the figure.

Within the meaning of the invention, after the decoding of a frame coded with an FD coder, an inverse DCT transformation is applied to the decoded frame. The latter is de-aliased and then the synthesis window is applied to the de-aliased signal. The synthesis windows of the FD coder are synchronized in such a way that the non-zero part of the window (on the left) corresponds with a new frame. Thus, the frame can be decoded up to the point A since the signal does not have any temporal aliasing before this point.

At the moment of the arrival of the LPD frame, as at the coder, the states or memories of the predictive decoding are reinitialized to predetermined values.

By state of the predictive decoding (LPD), at least the following states are implied:

- The state memory of the resampling filter for the internal frequency of the CELP decoding (12.8 or 16 kHz) at the output frequency fs. It is considered here that the resampling can be performed as a function of the input frequency and internal frequency by FIR filter, filter bank or IIR filter, knowing that an embodiment of FIR type simplifies the use of the state memory which corresponds to the past input signal.
- The state memories of the de-emphasis filter ($1/(1-\alpha z^{-1})$).
- The coefficients of the linear prediction filter at the end of the previous frame or their equivalent version in the domains such as the LSF (Line Spectral Frequencies) or ISF (Imittance Spectral Frequencies) domains.
- The state memory of the LPC synthesis filter typically of order 16 (in the preaccentuated domain).
- The memory of the adaptive dictionary (past excitation).
- The state memory of the low-frequency post-filter (LPF) as defined in the standard UIT-G.718 (see clause 7.14.1.1 of the standard UIT-T G.718).

The quantization memory for the fixed dictionary gain (when this quantization is performed with memory).

Figure 6:
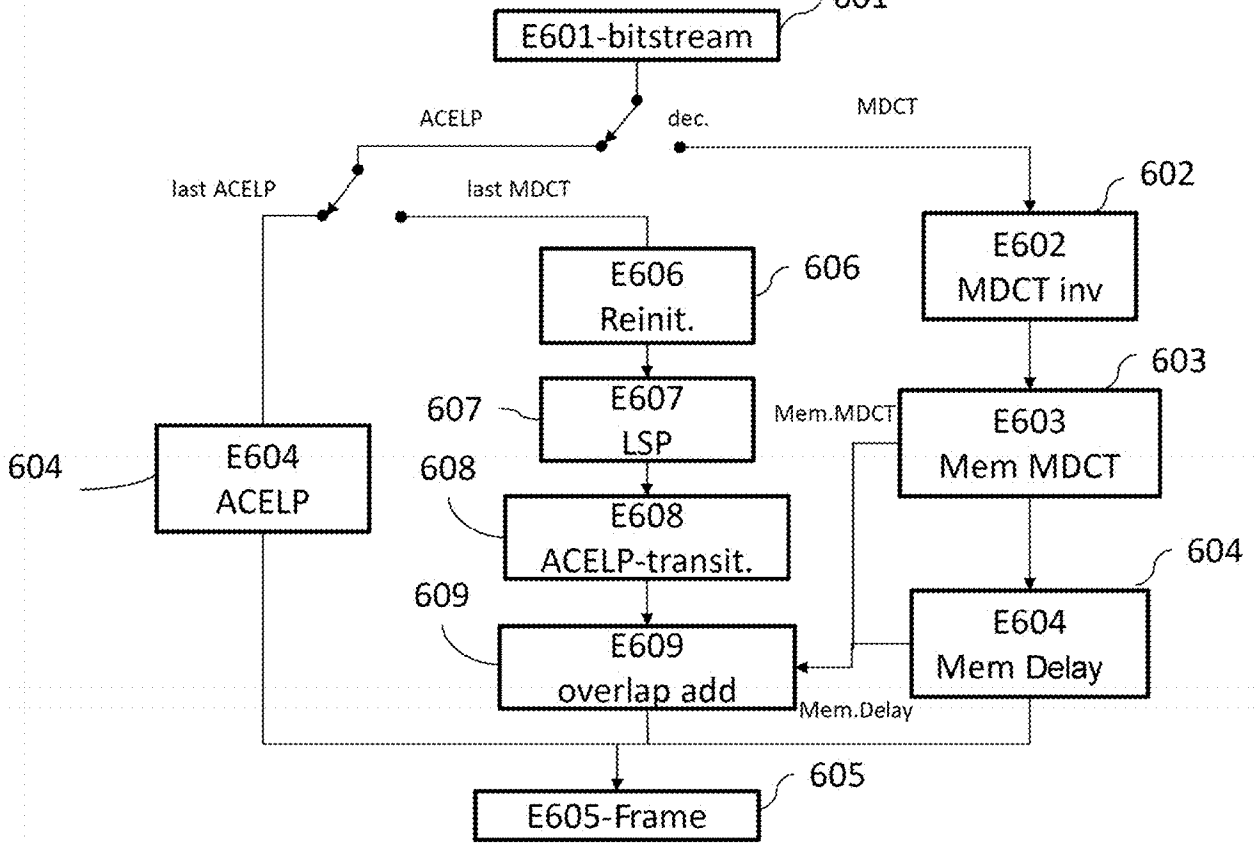
FIG. 6 illustrates an embodiment of the decoding method and of the decoder according to the invention.

FIG. 6 illustrates an embodiment of a decoder and of a decoding method according to the invention.

The particular embodiment lies within the framework of transition between an FD transform codec using an MDCT and a predictive codec of ACELP type.

After a first conventional step of reading in the binary train (E601) by a module 601, a decision module (dec.) determines whether the frame to be processed should be decoded by ACELP predictive decoding or by FD transform decoding.

In the case of an MDCT transform decoding, a step of decoding E602 by the transform decoding entity 602, makes it possible to obtain the frame in the transformed domain. The step can also contain a step of resampling at the sampling frequency of the ACELP decoder. This step is followed by an inverse MDCT transformation E603 comprising an inverse DCT transformation, a temporal de-aliasing, and the application of a synthesis window and of a step of overlap-add with the previous frame, as described subsequently with reference to FIG. 8.

The part for which the temporal aliasing has been canceled is placed in a frame in a step E605 by the frame placement module 605. The part which comprises a temporal aliasing is kept in memory (MDCT Mem.) to carry out a step of overlap-add at E609 by the processing module 609 with the next frame, if any, decoded by the FD core. In a variant, the stored part of the MDCT decoding which is used for the overlap-add step, does not comprise any temporal aliasing, for example in the case where a sufficiently significant temporal shift exists between the MDCT decoding and the CELP decoding.

Figure 8:
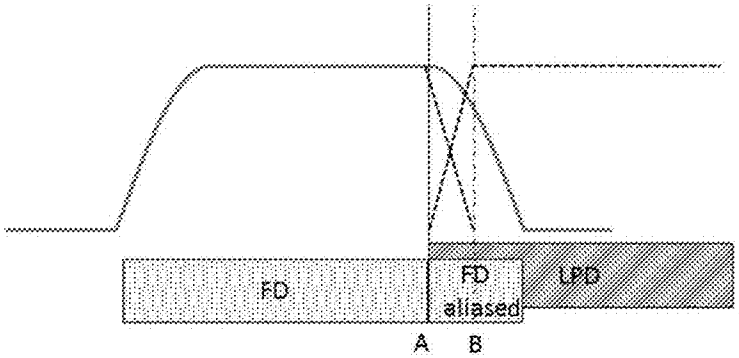
FIG. 8 illustrates the overlap-add step implemented during decoding according to an embodiment of the invention.

This step is illustrated in FIG. 8. It is seen in this figure that a temporal discontinuity exists between the decoding arising from the FD and that from the LPD. Step E609 uses the memory of the transform coder (MDCT Mem.), such as described hereinabove, that is to say the signal decoded after the point A but which comprises aliasing (in the case illustrated).

Preferentially, the signal is used up to the point B which is the point of aliasing of the transform. In a particular embodiment, this signal is compensated beforehand by the inverse of the window previously applied over the segment AB. Thus, before the overlap-add step the segment AB is corrected by the application of an inverse window compensating the windowing previously applied to the segment. The segment is therefore no longer "windowed" and its energy is close to that of the original signal.

The two segments AB, that arising from the transform decoding and that arising from the predictive decoding, are thereafter weighted and summed so as to obtain the final signal AB. The weighting functions preferentially have a sum equal to 1 (of the quadratic sinusoidal or linear type for example). Thus, the overlap-add step combines a signal segment synthesized by predictive decoding of the current frame and a signal segment synthesized by inverse transform decoding, corresponding to a stored segment of the decoding of the previous frame.

In another particular embodiment, in the case where the resampling has not yet been performed (at E602 for example), the signal segment synthesized by inverse transform decoding of FD type is resampled beforehand at the sampling frequency corresponding to the decoded signal segment of the current frame of LPD type. This resampling of the MDCT memory will be able to be done with or without delay with conventional techniques by filter of FIR type, filter bank, IIR filter or indeed by using "splines".

In the converse case, if the FD and LPD coding modes operate at different internal sampling frequencies, it will be possible in an alternative to resample the synthesis of the CELP coding (optionally post-processed with in particular the addition of an estimated or coded high band) and to apply the invention. This resampling of the synthesis of the LPD coder will be able to be done with or without delay with conventional techniques by filter of FIR type, filter bank, IIR filter or indeed by using "splines".

This makes it possible to perform a transition without defect in the case where the sampling frequency of the transform decoding is different from that of the predictive decoding.

In a particular embodiment, it is possible to apply an intermediate delay step (E604) so as to temporally align the two decoders if the FD decoder has less lag than the CELP (LPD) decoder. A signal part whose size corresponds to the lag between the two decoders is then stored in memory (Mem.delay).

Figure 9:
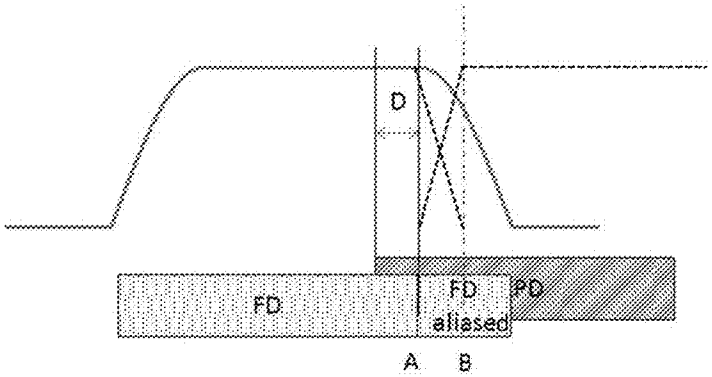
FIG. 9 illustrates a particular mode of implementation of the transition between transform decoding and predictive decoding when they have different delays.

FIG. 9 depicts this illustrative case. The embodiment here proposes to advantageously exploit this difference in lag D so as to replace the first segment D arising from the LPD predictive decoding with that arising from the FD transform decoding and then to undertake the overlap-add step (E609) such as described previously, on the segment AB. Thus, when the inverse transform decoding has a smaller processing delay than that of the predictive decoding, the first segment of current frame decoded by predictive decoding is replaced with a segment arising from the decoding of the previous frame corresponding to the delay shift and placement in memory during the decoding of the previous frame.

In FIG. 6, if the decision (dec.) indicates that it is necessary to do an ACELP predictive decoding, then:

- Either the last decoded frame, previous frame (last ACELP), was also decoded according to an ACELP predictive decoding by the ACELP decoding entity 603, the predictive decoding then continues in a step (E603), the audio frame is thus produced at E605.
- Or the previous frame (last MDCT) has been decoded by the transform decoding entity 602, at E602, in this case, a step (E606) of reinitialization of the states of the ACELP predictive decoding is applied. This reinitialization step is implemented by the reinitialization module 606, for at least one state of the predictive decoding. The reinitialization values are default values predetermined in advance (not necessarily zero).
- The initialization of the states of the LPD decoding can be done with default values predetermined in advance which may for example correspond to various types of frame to be decoded as a function of what was done during the encoding.

A step of predictive decoding for the current frame is then implemented at E608 by a predictive decoding entity 608, before the overlap-add step (E609) described previously. The step can also contain a step of resampling at the sampling frequency of the MDCT decoder.

This predictive coding E608 can, in a particular embodiment, be a transition predictive decoding, if this solution has been chosen at the encoder, in which the decoding of the excitation is direct and does not use any adaptive dictionary. In this case, the memory of the adaptive dictionary does not need to be reinitialized.

A non-predictive decoding of the excitation is then carried out. This embodiment allows predictive decoders of LPD type to stabilize much more rapidly since in this case it does not use the memory of the adaptive dictionary which had been previously reinitialized. This further simplifies the implementation of the transition according to the invention. When decoding the current frame, the predictive decoding of the long-term excitation is replaced with a non-predictive decoding of the excitation.

In a particular embodiment, a step E607 of calculating the coefficients of the linear prediction filter for the current frame is performed by the calculation module 607.

Several modes of calculation of the coefficients of the linear prediction filter are possible for the current frame.

In a first embodiment, the prediction coefficients in the previous frame (OLD) of FD type are not known since no LPC coefficient is coded in the FD coder and the values have been reinitialized to zero. One then chooses to decode coefficients of a unique linear prediction filter, i.e. that corresponding to the end-of-frame prediction filter (NEW), or that corresponding to the middle-of-frame prediction filter (MID). Identical coefficients are thereafter allotted to the end-, middle- and start-of-frame linear prediction filter.

Figure 7:
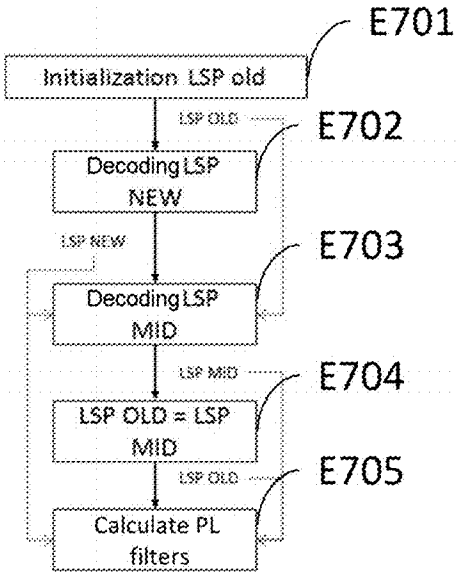
FIG. 7 illustrates in the form of a flowchart the steps implemented in an embodiment of the invention, to determine the coefficients of the linear prediction filter during the predictive decoding of the current frame, the previous frame having been decoded according to an inverse transform decoding.

In a second possible embodiment, the steps illustrated in FIG. 7 are implemented. A first step E701 is the initialization of the coefficients of the prediction filter (LSP OLD) according to the implementation of step E606 of FIG. 6. Step E702 decodes the coefficients of the end-of-frame filter (LSP NEW) and the decoded values obtained (LSP NEW) as well as the predetermined reinitialization values of the coefficients of the start-of-frame filter (LSP OLD) are used jointly at E703 to decode the coefficients of the middle-of-frame prediction filter (LSP MID). A step E704 of replacement of the values of start-of-frame coefficients (LSP OLD) by the decoded values of the middle-of-frame coefficients (LSP MID) is performed. Step E705 makes it possible to determine the coefficients of the linear prediction filter for the current frame on the basis of these values thus decoded (LSP OLD, LSP MID, LSP NEW).

In a third possible embodiment, the coefficients of the linear prediction filter for the previous frame (LSP OLD) are initialized to a predetermined value, for example according to the long-term average value of the LSP coefficients. In this case, it will be possible to use a "normal" decoding such as used in G.718, the sub-frame-based linear prediction coefficients being calculated as an interpolation between the values of the prediction filters OLD, MID and NEW. This operation thus allows the LPD coder to stabilize more rapidly.

Figure 10:
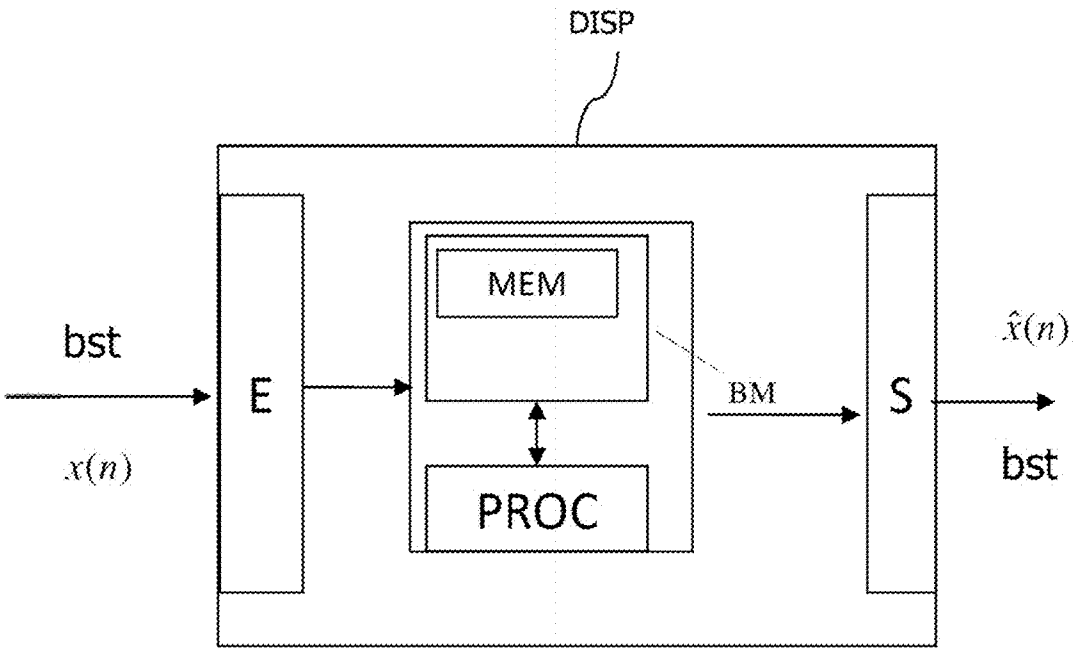
FIG. 10 illustrates a hardware embodiment of the coder or of the decoder according to the invention.

With reference to FIG. 10, a hardware device adapted to embody a coder or a decoder according to an embodiment of the present invention is described.

This coder or decoder can be integrated into a communication terminal, a communication gateway or any type of equipment such as a set top box type decoder, or audio stream reader.

This device DISP comprises an input for receiving a digital signal which in the case of the coder is an input signal x(n) and in the case of the decoder, the binary train bst.

The device also comprises a digital signals processor PROC adapted for carrying out coding/decoding operations in particular on a signal originating from the input E.

This processor is linked to one or more memory units MEM adapted for storing information necessary for driving the device in respect of coding/decoding. For example, these memory units comprise instructions for the implementation of the decoding method described hereinabove and in particular for implementing the steps of decoding according to an inverse transform decoding of a previous frame of samples of the digital signal, received and coded according to a transform coding, of decoding according to a predictive decoding of a current frame of samples of the digital signal, received and coded according to a predictive coding, a step of reinitialization of at least one state of the predictive decoding to a predetermined default value and an overlap-add step which combines a signal segment synthesized by predictive decoding of the current frame and a signal segment synthesized by inverse transform decoding, corresponding to a stored segment of the decoding of the previous frame.

When the device is of coder type, these memory units comprise instructions for the implementation of the coding method described hereinabove and in particular for implementing the steps of coding a previous frame of samples of the digital signal according to a transform coding, of receiving a current frame of samples of the digital signal to be coded according to a predictive coding, a step of reinitialization of at least one state of the predictive coding to a predetermined default value.

These memory units can also comprise calculation parameters or other information.

More generally, a storage means, readable by a processor, possibly integrated into the coder or into the decoder, optionally removable, stores a computer program implementing a decoding method and/or a coding method according to the invention. FIGS. 3 and 6 may for example illustrate the algorithm of such a computer program.

The processor is also adapted for storing results in these memory units. Finally, the device comprises an output S linked to the processor so as to provide an output signal which in the case of the coder is a signal in the form of a binary train bst and in the case of the decoder, an output signal $\hat{x}(n)$.

Although the present disclosure has been described with reference to one or more examples, workers skilled in the art will recognize that changes may be made in form and detail without departing from the scope of the disclosure and/or the appended claims.

The invention claimed is:

1. A decoding method for decoding a digital audio signal, comprising the following acts performed by a decoding device:

receiving the digital audio signal;

decoding according to an inverse transform decoding of a previous frame of samples of the digital signal, received and coded according to a transform coding;

decoding according to a predictive decoding of a current frame of samples of the digital signal, received and coded according to a predictive coding, wherein the predictive decoding of the current frame is a transition predictive decoding which does not use any adaptive dictionary arising from the previous frame;

reinitializing at least one state of the predictive decoding to a predetermined default value; and an overlap-add act, which combines a signal segment synthesized by the predictive decoding of the current frame and a signal segment synthesized by inverse transform decoding, corresponding to a stored segment of the decoding of the previous frame.

2. The decoding method as claimed in claim 1, wherein the inverse transform decoding has a smaller processing delay than that of the predictive decoding and wherein a first segment of the current frame decoded by the predictive decoding is replaced with a segment arising from the inverse transform decoding of the previous frame, wherein a size of the segment arising from the inverse transform decoding of the previous frame corresponds to a delay shift between the predictive decoding and the inverse transform decoding, and wherein the segment arising from the inverse transform decoding of the previous frame is stored in memory during the decoding of the previous frame.

3. The decoding method as claimed in claim 1, wherein the signal segment synthesized by inverse transform decoding is corrected before the overlap-add act by application of an inverse window compensating a window previously applied to the signal segment synthesized by inverse transform decoding.

4. The decoding method as claimed in claim 1, wherein the signal segment synthesized by inverse transform decoding is resampled beforehand at a sampling frequency corresponding to the synthesized signal segment of the current frame.

5. The decoding method as claimed in claim 1, wherein a state of the predictive decoding is in a list of the following states:

a state memory for a filter for resampling at an internal frequency of the predictive decoding;

state memories for pre-emphasis/de-emphasis filters;

coefficients of a linear prediction filter;

a state memory of a synthesis filter;

a memory of an adaptive dictionary;

a state memory of a low-frequency post-filter;

a quantization memory for fixed dictionary gain.

6. The decoding method as claimed in claim 5, wherein a calculation of coefficients of a linear prediction filter for the predictive decoding of the current frame is performed by decoding coefficients of a unique filter and by allotting identical coefficients to an end-of-frame linear prediction filter, a middle-of-frame linear prediction filter and a start-of-frame linear prediction filter.

7. The decoding method as claimed in claim 5, further comprising calculation of coefficients of a linear prediction filter for the predictive decoding of the current frame, which comprises the following acts:

determination of decoded values of coefficients of a middle-of-frame filter by using decoded values of coefficients of an end-of-frame filter and predetermined reinitialization values of coefficients of a start-of-frame filter;

replacement of the predetermined reinitialization values of coefficients of the start-of-frame filter by the determined decoded values of the coefficients of the middle-of-frame filter;

determination of coefficients of a linear prediction filter for the predictive decoding of the current frame by using the determined decoded values of the coefficients of the end-of-frame filter, the middle-of-frame filter and the start-of-frame filter.

8. The decoding method as claimed in claim 5, wherein coefficients of a start-of-frame linear prediction filter are reinitialized to predetermined values corresponding to average values of long-term prediction filter coefficients and wherein linear prediction coefficients of a linear prediction filter for the predictive decoding of the current frame are determined by using the predetermined values and decoded values of coefficients of an end-of-frame filter.

9. A method for coding a digital audio signal, comprising the following acts performed by a coding device:

coding a previous frame of samples of the digital signal according to a transform coding;

reception of a current frame of samples of the digital signal to be coded according to a predictive coding, wherein the predictive coding of the current frame is a transition predictive coding which does not use any adaptive dictionary arising from the previous frame; and reinitializing at least one state of the predictive coding to a predetermined default value.

10. The coding method as claimed in claim 9, wherein coefficients of a linear prediction filter form part of at least one state of the predictive coding and calculation of coefficients of a linear prediction filter for the predictive coding of the current frame is performed by determination of values of coefficients of a single prediction filter, either of middle or of end of frame prediction filter and of allotting of identical values for coefficients of the start-of-frame prediction filter and end-or middle-of-frame prediction filter.

11. The coding method as claimed in claim 10, wherein at least one state of the predictive coding is coded in a direct manner.

12. The coding method as claimed in claim 9, wherein coefficients of a linear prediction filter form part of at least one state of the predictive coding and calculation of coefficients of a linear prediction filter for predictive coding of the current frame comprises the following acts:

determination of coded values of coefficients of a middle-of-frame filter by using coded values of coefficients of an end-of-frame filter and predetermined reinitialization values of coefficients of a start-of-frame filter;

replacement of the predetermined reinitialization values of coefficients of the start-of-frame filter by the determined coded values of the coefficients of the middle-of-frame filter;

determination of the coefficients of the linear prediction filter for the predictive coding of the current frame by using the determined coded values of the coefficients of the end-of-frame filter, the middle-of-frame filter and the start-of-frame filter.

13. The coding method as claimed in claim 9, wherein coefficients of a linear prediction filter form part of at least one state of the predictive coding, coefficients of a start-of-frame linear prediction filter are reinitialized to predetermined values corresponding to average values of long-term prediction filter coefficients and wherein linear prediction coefficients of a linear prediction filter for predictive coding of the current frame are determined by using the predetermined values and coded values of coefficients of an end-of-frame filter.

14. A digital audio signal decoder, comprising:

a processor; and a non-transitory computer-readable medium comprising instructions stored thereon, which when executed by the processor configure the digital audio signal decoder to perform acts comprising:

an inverse transform decoding a previous frame of samples of the digital signal, received and coded according to a transform coding;

predictive decoding a current frame of samples of the digital signal, received and coded according to a predictive coding, wherein the predictive decoding of the current frame is a transition predictive decoding which does not use any adaptive dictionary arising from the previous frame;

reinitializing at least one state of the predictive decoding by a predetermined default value; and performing an overlap-add which combines a signal segment synthesized by predictive decoding of the current frame and a signal segment synthesized by inverse transform decoding, corresponding to a stored segment of the decoding of the previous frame.

15. A digital audio signal coder, comprising:

a processor; and a non-transitory computer-readable medium comprising instructions stored thereon, which when executed by the processor configure the digital audio signal coder to perform acts comprising:

transform coding a previous frame of samples of the digital signal;

predictive coding a current frame of samples of the digital signal, wherein the predictive coding of the current frame is a transition predictive coding which does not use any adaptive dictionary arising from the previous frame; and reinitializing at least one state of the predictive coding by a predetermined default value.

16. A non-transitory computer-readable medium comprising a computer program stored thereon having instructions for execution of a decoding method when the instructions are executed by a processor of a decoding device, wherein the instructions configure the decoding device to perform acts of:

receiving a digital audio signal;

decoding according to an inverse transform decoding of a previous frame of samples of the digital audio signal, received and coded according to a transform coding;

decoding according to a predictive decoding of a current frame of samples of the digital signal, received and coded according to a predictive coding, wherein the predictive decoding of the current frame is a transition predictive decoding which does not use any adaptive dictionary arising from the previous frame;

reinitializing at least one state of the predictive decoding to a predetermined default value; and an overlap-add act, which combines a signal segment synthesized by the predictive decoding of the current frame and a signal segment synthesized by inverse transform decoding, corresponding to a stored segment of the decoding of the previous frame.

* * * * *